US006915831B2

(12) United States Patent
Anderson

(10) Patent No.: US 6,915,831 B2
(45) Date of Patent: Jul. 12, 2005

(54) DRUM FOR WRAPPING A CORD

(75) Inventor: Richard N. Anderson, Whitesville, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 34 days.

(21) Appl. No.: 10/613,657

(22) Filed: Jul. 3, 2003

(65) Prior Publication Data

US 2004/0016517 A1 Jan. 29, 2004

Related U.S. Application Data

(63) Continuation-in-part of application No. 09/907,429, filed on Jul. 17, 2001, now Pat. No. 6,588,480.
(60) Provisional application No. 60/219,926, filed on Jul. 21, 2000.

(51) Int. Cl.[7] ..... E06B 9/32
(52) U.S. Cl. ..... 160/173 R; 242/366; 242/613.1
(58) Field of Search ..... 160/170, 173 R; 242/613.1, 365.1, 366, 366.1, 366.2; 254/374

(56) References Cited

U.S. PATENT DOCUMENTS

| | | | | |
|---|---|---|---|---|
| 1,799,137 A | | 3/1931 | Simpson | |
| 2,227,211 A | | 12/1940 | Balthasar | |
| 2,250,106 A | | 7/1941 | Lorentzen | |
| 2,334,132 A | | 11/1943 | Sherwood | |
| 2,580,252 A | | 12/1951 | Stuber et al. | |
| 2,851,098 A | | 9/1958 | Rosenbaum | |
| 3,352,349 A | | 11/1967 | Hennequin | |
| 4,574,597 A | * | 3/1986 | Buck et al. | 66/125 R |
| 4,623,012 A | | 11/1986 | Rude et al. | |
| 4,633,917 A | * | 1/1987 | Riboli | 139/452 |
| 4,890,800 A | * | 1/1990 | Lenk et al. | 242/366 |
| 5,228,491 A | | 7/1993 | Rude et al. | |
| 5,328,113 A | * | 7/1994 | de Chevron Villette et al. | 242/388 |
| 5,725,040 A | | 3/1998 | Domel | |
| 5,746,382 A | * | 5/1998 | Tsutsumi | 242/322 |
| 5,908,062 A | * | 6/1999 | Fun | 160/170 |
| 5,996,670 A | | 12/1999 | Igarashi | |
| 6,056,036 A | | 5/2000 | Todd et al. | |
| 6,076,587 A | | 6/2000 | Pastor | |
| 6,079,471 A | | 6/2000 | Kuhar | |
| 6,129,131 A | | 10/2000 | Colson | |
| 6,223,802 B1 | | 5/2001 | Colson | |
| 6,536,503 B1 | * | 3/2003 | Anderson et al. | 160/84.04 |
| 6,561,252 B2 | | 5/2003 | Anderson et al. | |
| 6,588,480 B2 | | 7/2003 | Anderson | |
| 6,619,365 B1 | * | 9/2003 | Wen et al. | 160/168.1 P |

FOREIGN PATENT DOCUMENTS

| | | |
|---|---|---|
| CH | 581 257 | 10/1976 |
| CH | 672 658 | 12/1989 |
| DE | 19505824 | 8/1996 |
| DE | 298 07 940 U1 | 10/1998 |
| GB | 13798 | 7/1893 |
| GB | 923205 | 2/1960 |
| GB | 931344 | 1/1961 |
| GB | 986529 | 3/1965 |
| GB | 1132985 | 11/1968 |
| GB | 2163202 | 1/1988 |
| JP | 11270253 | 10/1999 |
| NZ | 154363 | 9/1969 |

* cited by examiner

*Primary Examiner*—Blair M. Johnson
(74) *Attorney, Agent, or Firm*—Camoriano and Associates; Theresa Fritz Camoriano; Guillermo E. Camoriano

(57) ABSTRACT

A cord-wrapping device has a cord attached to a drum and includes a steeply inclined inlet portion and a second less inclined portion adjacent to said steeply inclined inlet. A cord feed guide directs the cord to begin wrapping onto the steeply inclined portion of the drum, and the slope of the steeply inclined inlet portion is sufficient that the cord slides downwardly along the slope of the steeply inclined portion toward the second inclined portion as the drum rotates to wind the cord onto the drum, without requiring an external pushing force to cause the cord to slide.

13 Claims, 9 Drawing Sheets

DRUM FOR WRAPPING A CORD

BACKGROUND OF THE INVENTION

This is a continuation-in-part of U.S. application Ser. No. 09/907,429, filed Jul. 17, 2001now U.S. Pat No. 6,588,480, which claims priority from provisional application Ser. No. 60/219,926, filed Jul. 21, 2000 both of which are hereby incorporated herein by reference.

The present invention relates to a drum for wrapping a cord. The cord may be a lift cord, used for raising and lowering a window blind or other window covering, it may be a drive cord for driving a mechanism within a window covering, it may be a tilt cord, which tilts the slats open and closed, or it may be used for other purposes, including purposes unrelated to window blinds or shades.

Typically, a blind transport system will have a top head rail which both supports the blind and hides the mechanisms used to raise and lower or open and close the blind. Such a blind system is described in U.S. Pat. No. 6,536,503, which is hereby incorporated herein by reference. The raising and lowering usually is done by a lift cord attached to the bottom rail (or bottom slat). The tilting of the slats in the blind is typically accomplished with ladder tapes (and/or tilt cables) which run along the front and back of the stack of slats. The lift cords (in contrast to the tilt cables) may either run along the front and back of the stack of slats or they may run through slits in the middle of the slats, and they are connected to the bottom rail.

Many different drive mechanisms are known for raising and lowering blinds and for tilting the slats. A cord drive to raise or lower the blind is very handy. It does not require a source of electrical power, and the cord may be placed where it is readily accessible, avoiding any obstacles.

In prior art cord drives used for blinds, it is typical for the same cord to be used to drive the lift action and to extend through the slats and fasten to the bottom slat (or bottom rail) to lift the blind. However, it is also known to use one cord to drive the lift action (a drive cord) and another cord to lift the blind (a lift cord). Various types of drums are used for driving the lift, driving the tilt, and wrapping up the lift cords as the blind is raised and lowered. Some drums shift longitudinally as they wrap up the cord, in order to keep the cord from overwrapping onto itself, and others use other mechanisms, such as kickers, to guide the cord onto the drum while preventing overwrapping. The mechanisms that shift longitudinally are fairly complex, requiring many moving parts. The mechanisms that rely on kickers work well, but they create large thrust forces and therefore large frictional forces as the kicker pushes the cord along the drum.

SUMMARY OF THE INVENTION

The present invention provides a cord winding mechanism which eliminates many of the problems of prior art cord drums.

An objective of the present invention is to have a simple winding system with a minimum of moving parts, which will consistently and reliably wind and unwind the cord without jamming or over-wrapping, and without requiring the drum to shift longitudinally as it rotates.

A preferred embodiment of the invention disclosed herein depicts a mechanism to ensure the orderly wrapping of the cord onto the drum without requiring a shoulder or a "kicker" to push the cord along the drum in order to make room for new wraps of the cord. This mechanism may be used on a drum used for lift cords, on a tilt drum, on a drive drum, or on other types of drums, including on a pair of drums used for a counterwrap cord drive arrangement, as disclosed in U.S. application Ser. No. 09/907,429. The drum of the present invention may be used wherever there is a need to convert a linear motion (of the cord) into a rotary motion or vice versa.

DESCRIPTION OF THE PREFERRED EMBODIMENTS

Figure 1:
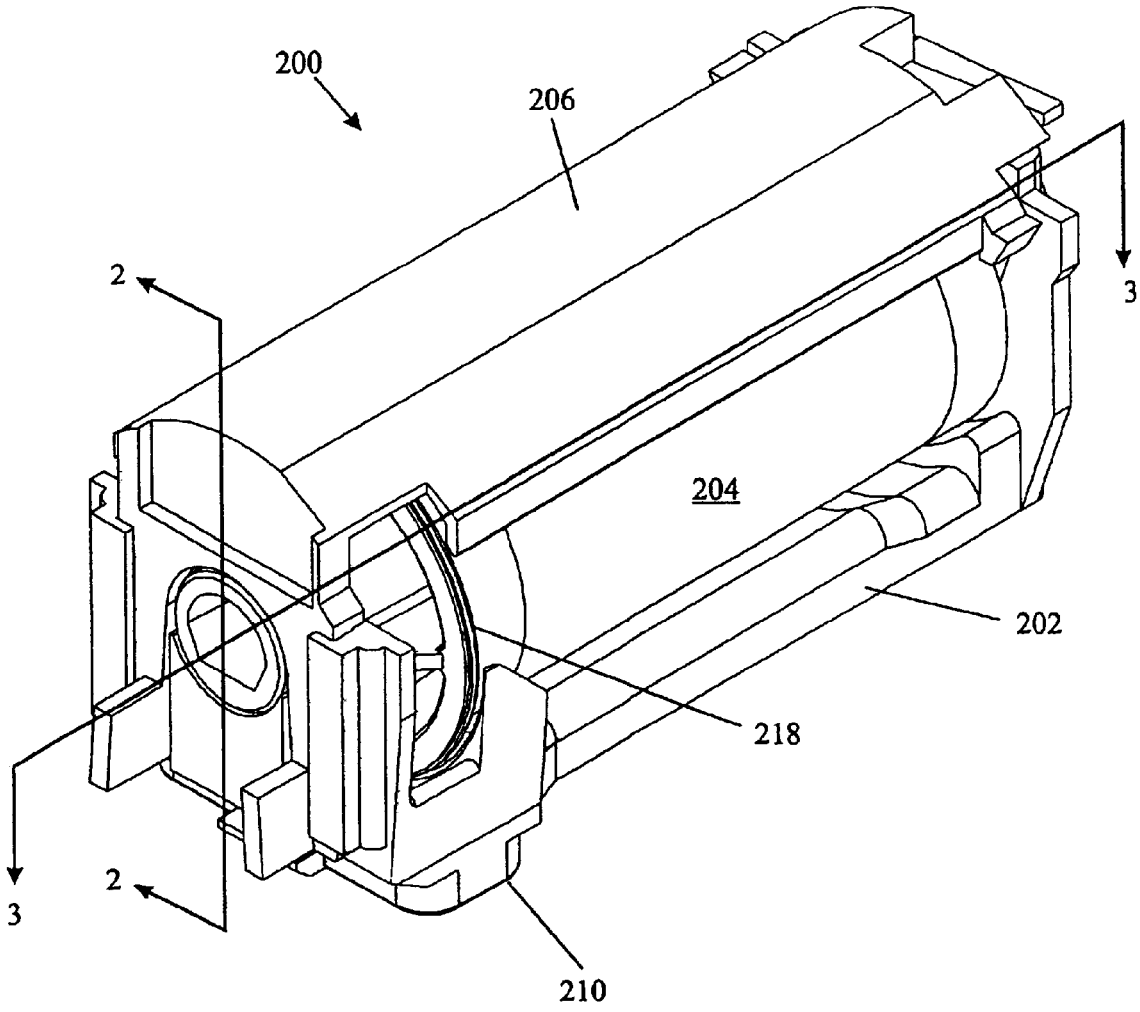
Fig. 1 Prior Art
FIG. 1 is a perspective view of a prior art cord drum used as a lift station for winding up the lift cord of a window blind.

FIGS. 1–3 and 11 show a lift cord station 200, which is disclosed and described in detail in U.S. Pat. No. 6,536,503, which is hereby incorporated herein by reference. The main components of this lift station 200 include a cradle 202, a wind-up spool or drum 204, a securing clip 206, and a lift cord 207. The cradle 202 is fixed, and the drum 204 is mounted on the cradle 202 for rotation about an axis 216 relative to the cradle 202. As the drum 204 rotates in one direction (clockwise when viewed from the left of FIG. 2), it winds up the cord 207, raising the window covering, and, as it rotates in the opposite direction, it lowers the window covering. The cradle 202 includes a finger or "kicker" 208, shown in FIG. 3, which pushes the cord along the drum to make room for the incoming wrap of cord.

Figure 2:
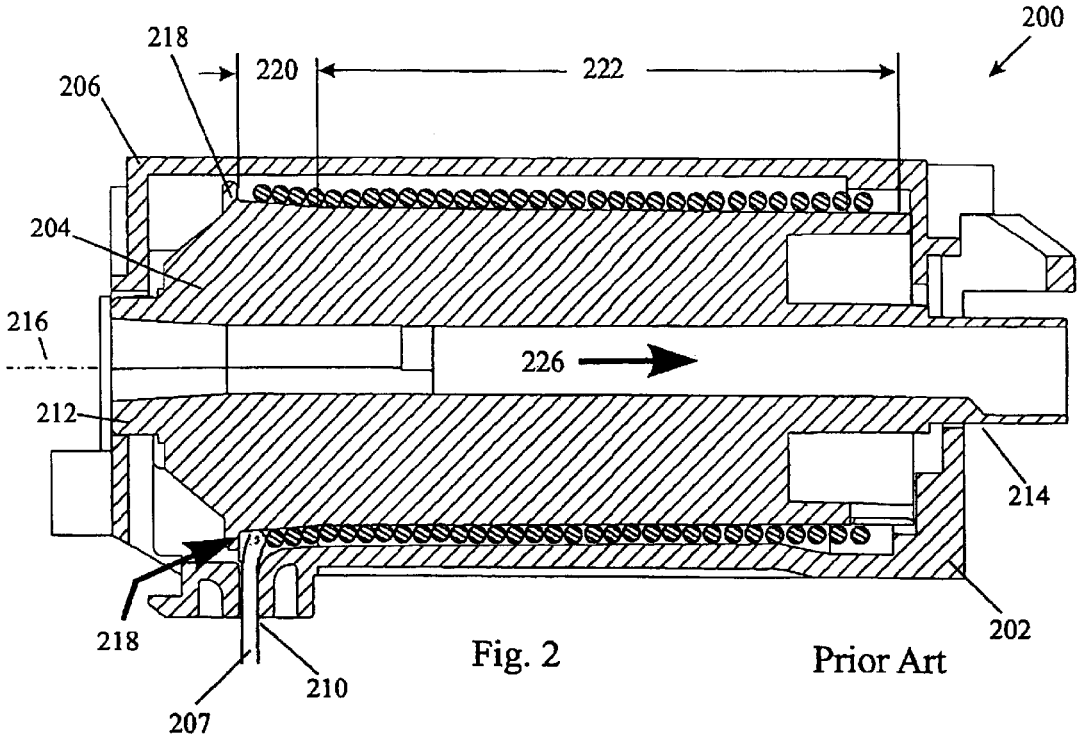
Fig. 2 Prior Art
FIG. 2 is a sectional view along line 2—2 of FIG. 1.

Referring to FIG. 2, the cradle 202 includes a cord guide 210, which positions the cord feed onto the drum 204. The width of the cord guide 210 is only slightly greater than the diameter of the cord in order to ensure that the cord is positioned precisely onto the drum. The drum 204 is a substantially cylindrical element defining upstream and downstream ends 212, 214, respectively, and an axis of rotation 216. The drum 204 includes a shoulder 218 proximate the upstream end 212, a first slightly-tapered drum surface portion 220, and a second substantially cylindrical drum surface portion 222. This second drum surface portion 222 may have a very slight taper to assist in mold release in the manufacturing process, and this very slight taper may also assist in minimizing the drag of pushing wraps of the cord 207 across the drum surface, but the taper of this second portion 222, if any, is less than the taper of the first, slightly tapered portion 220.

Figure 11:
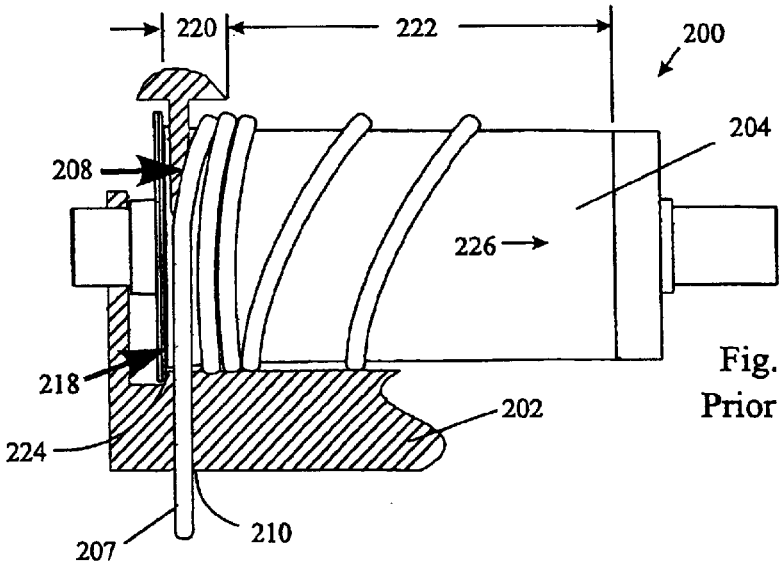
Fig. 11 Prior Art
FIG. 11 is an enlarged, schematic, rear sectional view of a prior art cord drum similar to the drum of FIG. 2.

The shoulder 218 is used to accurately position the drum 204 on the cradle 202, best illustrated schematically in FIG. 11, wherein the shoulder 218 contacts the lip 224 on the cradle 202. The lip 224 acts as a thrust bearing surface to counter the thrust load, which acts in the direction of the arrow 226. The kicker 208 and lip 224 form a continuous arc in this design, with the kicker 208 extending over approximately 180°. The thrust load is caused by the kicker 208 pushing the consecutive wraps of the cord 207 from their initial wrap point at the feed guide 210, adjacent the shoulder 218, toward the second end 214 of the drum 204 as the cord 207 winds up on the drum 204. This shifts the drum 204 to the right until the flange 218 comes into contact with the left side of the kicker 208, generating thrust resistance.

Figure 3:
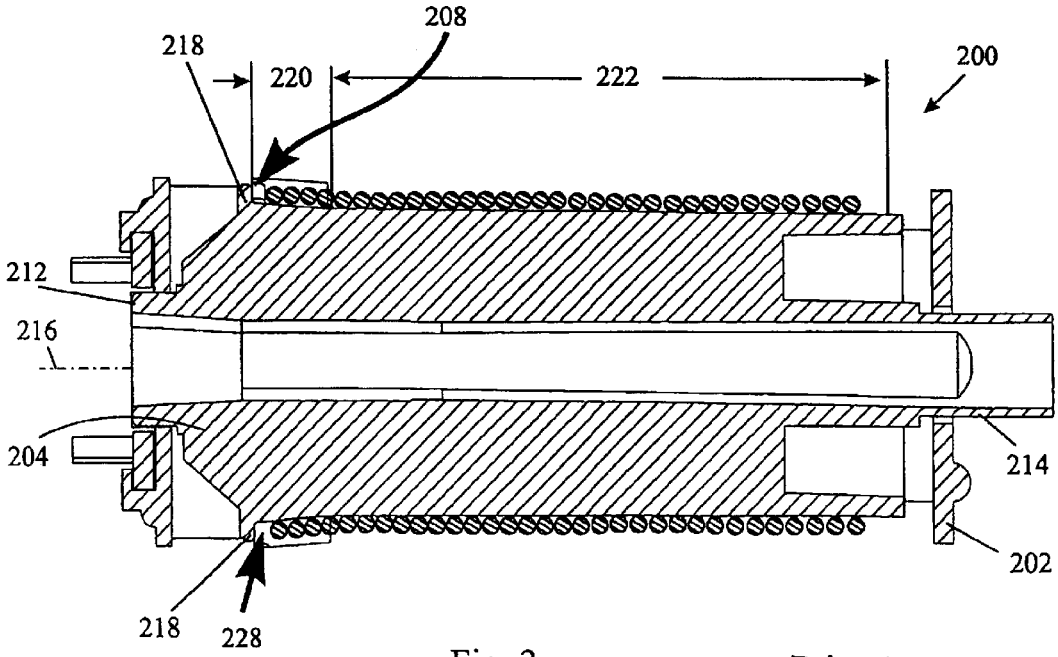
Fig. 3 Prior Art
FIG. 3 is a sectional view along line 3—3 of FIG. 1.

Referring to FIGS. 3 and 11, the taper on the first drum surface portion 220 is so slight that the wraps of cord 207 initially formed on this first portion 220 do not automatically slide down along the taper, pushing all previous wraps of cord 207 along with them. To ensure that the latest wrap of cord 207 that is formed does in fact move down the taper to create room for new wraps to form without causing an over-wrap condition, the kicker 208 is placed adjacent the shoulder 218. As the cord 207 winds up onto the drum 204, the kicker 208 displaces the cord 207 down along the first tapered portion 220, away from its initial position, so as to create a space 228 (See FIG. 3) where the incoming cord 207 can be laid down without overwrapping onto the cord that is already on the drum 204.

In this prior art embodiment of a cord drum, the shoulder 218 is not in contact with the cord 207. The shoulder 218 accurately positions the drum 204 on the cradle 202 and acts as a thrust bearing surface to take up the heavy thrust load created by the kicker 208 pushing the cord 207 away from the inlet end 212 of the drum 204 in the direction of the arrow 226. The kicker 208 serves to push the cord 207 along the slightly tapered portion 220 to make a space 228 for the next wrap to form on the drum 204. The taper of the drum 204 then makes it easy for previously formed wraps to be pushed along as well. Finally, the feed guide 210 ensures that the new wrap 228 of the cord 207 is accurately placed at the space 228 on the drum surface, between the shoulder 218 and the previous wrap of the cord, which has been laterally displaced by the kicker 208 so that no over-wrap condition occurs.

Figure 4:
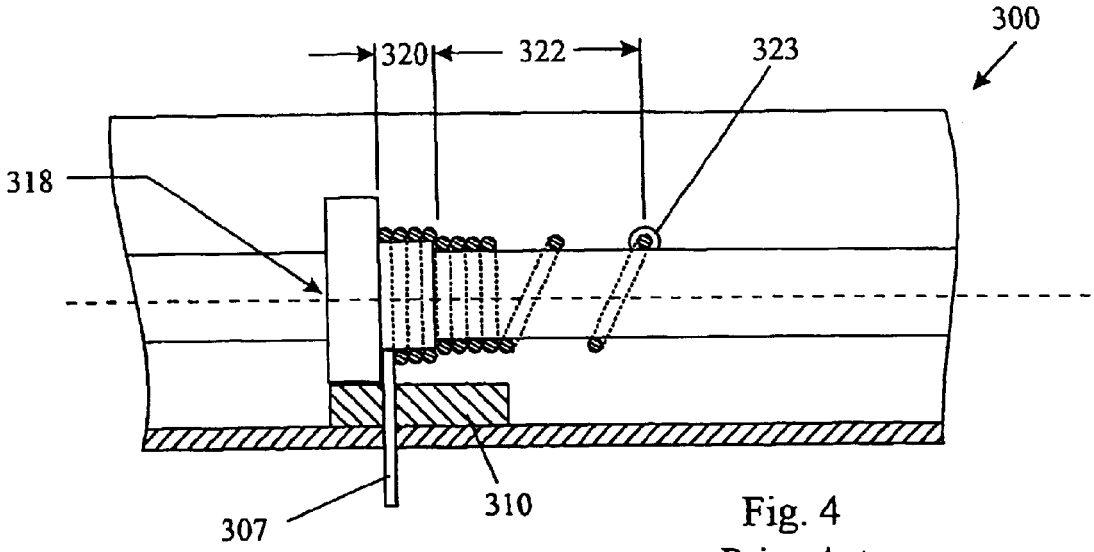
Fig. 4 Prior Art
FIG. 4 is a schematic sectional view of another prior art cord drum.

Another prior art cord drum 300 is shown in FIG. 4. FIG. 4 schematically depicts the drum disclosed in U.S. Pat. No. 5,328,113, de Chevron Villette et al., which is hereby incorporated herein by reference. This patent is assigned to Somfy and is hereinafter referred to as the Somfy patent. This cord drum 300 includes a shoulder 318, a first cylindrical drum surface portion 320, a second cylindrical surface drum portion 322 of slightly smaller diameter than the first cylindrical drum portion 320, and a cord 307. A feed guide 310 is used to precisely place the cord 307 onto the first drum portion 320, directly adjacent the shoulder 318. The cord 307 is attached to the second drum portion 322 at a position 323 that is distant from the inlet position.

The theory behind the Somfy design is that the first cylindrical drum portion 320 is long enough to have sufficient wraps of the cord 307 to handle the load pulling down on the cord 307. Any ensuing wraps of the cord 307 beyond this first drum portion 320 will thus have zero tension and will slide readily along the length of the second drum portion 322 (See Somfy patent Column 3, lines 15–20 and Column 3, lines 28–30). Furthermore, the wraps formed on the first drum portion 320 are pushed back (they do not automatically slide back since the first drum portion is not sloped) by the latest wrap being formed under the effect of the load and the reaction of the shoulder 318 on the cord 307.

Figure 5:
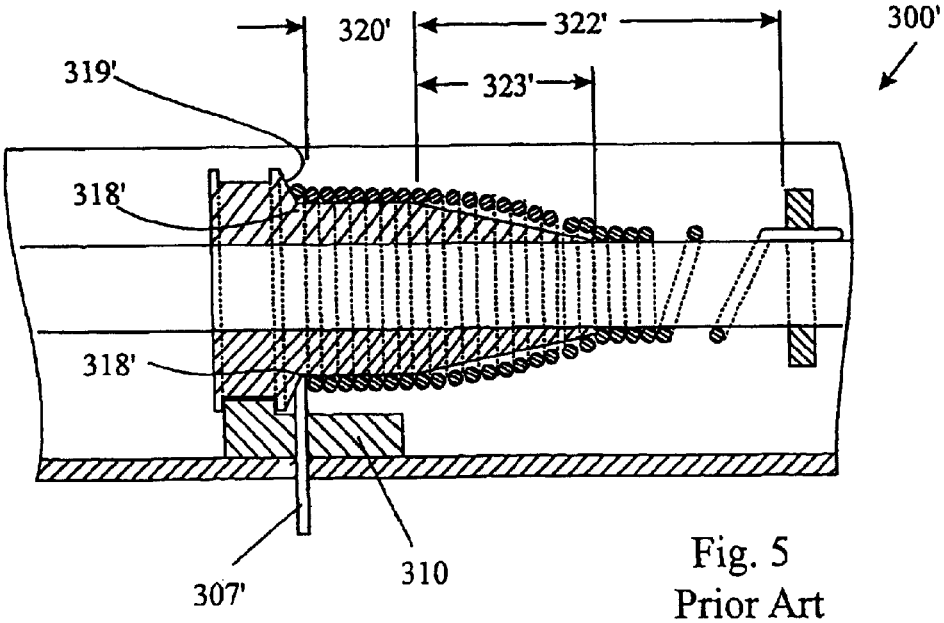
Fig. 5 Prior Art
FIG. 5 is a schematic sectional view of still another prior art cord drum.
Figure 10:
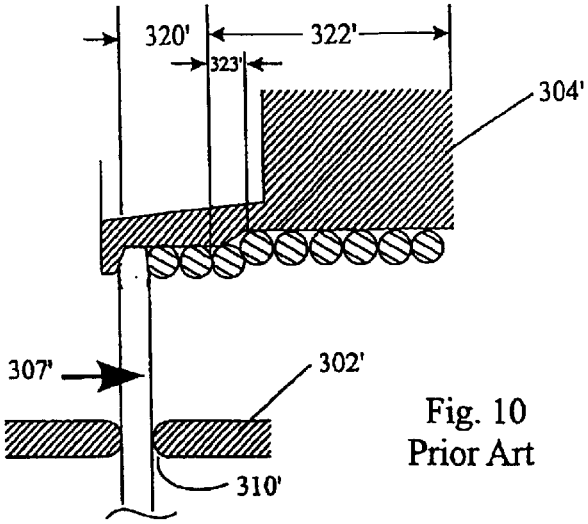
Fig. 10 Prior Art
FIG. 10 is a broken away, enlarged, sectional view of the prior art cord drum of FIG. 5.

FIG. 5 shows a second embodiment 300' that is also taught in the aforementioned Somfy patent. The main differences between the first embodiment 300 and this second embodiment 300' are that a tapered drum portion 323' has been added at the beginning of the second drum portion 322', and the shoulder 318' has a steeply tapered surface 319' as opposed to the vertical surface of the first shoulder 318. As stated in the Somfy patent (See Column 3, lines 51–53), the purpose of the steeply tapered shoulder 318' is to make it possible to more accurately direct the cord 307 as it wraps onto the first drum portion 320'. This is depicted schematically in FIG. 10.

In both of the above referenced embodiments 300, 300', it is clear that the incoming cord 307, 307' is accurately placed directly on the surface of the first cylindrical drum portion 320, 320' by the feed guide 310, 310'. The guide 310' does not place the cord onto the steeply tapered surface 319'. It is the reaction of the weight of the load pulling down on the cord 307, 307' against the shoulder 318, 318' which is supposed to push the existing wraps on the first drum portion 320, 320' to make room for the incoming cord 307, 307' that is being guided onto the first drum portion 320, 320' by the feed guide 310, 310'.

Figure 6:
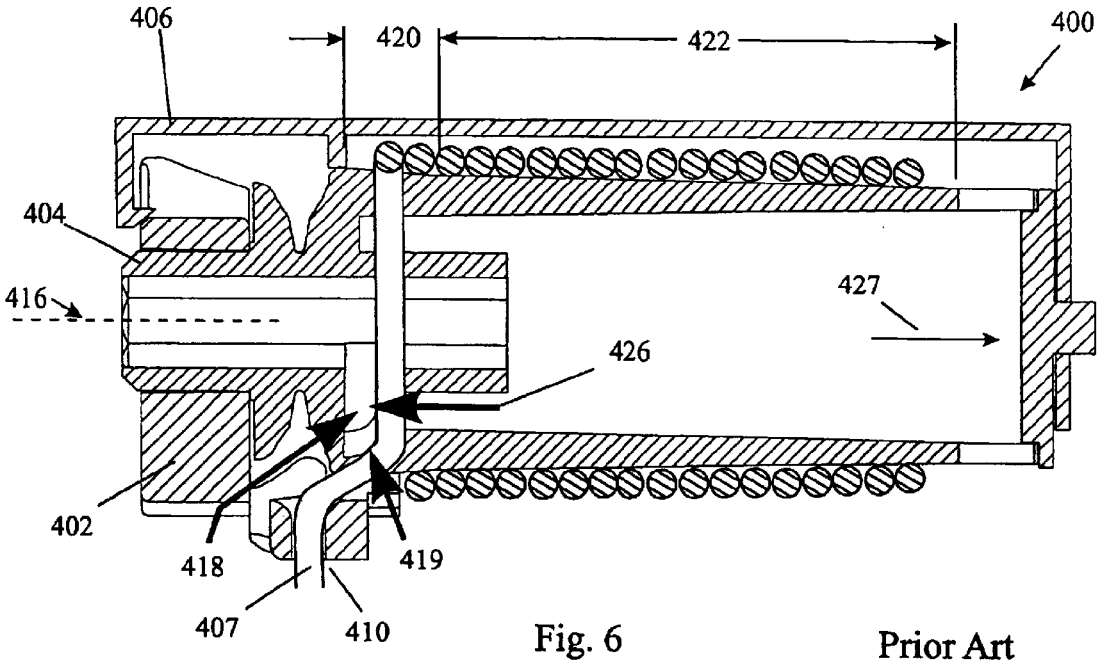
Fig. 6 Prior Art
FIG. 6 is a sectional view, similar to that of FIG. 2, but for another prior art cord drum.
Figure 7:
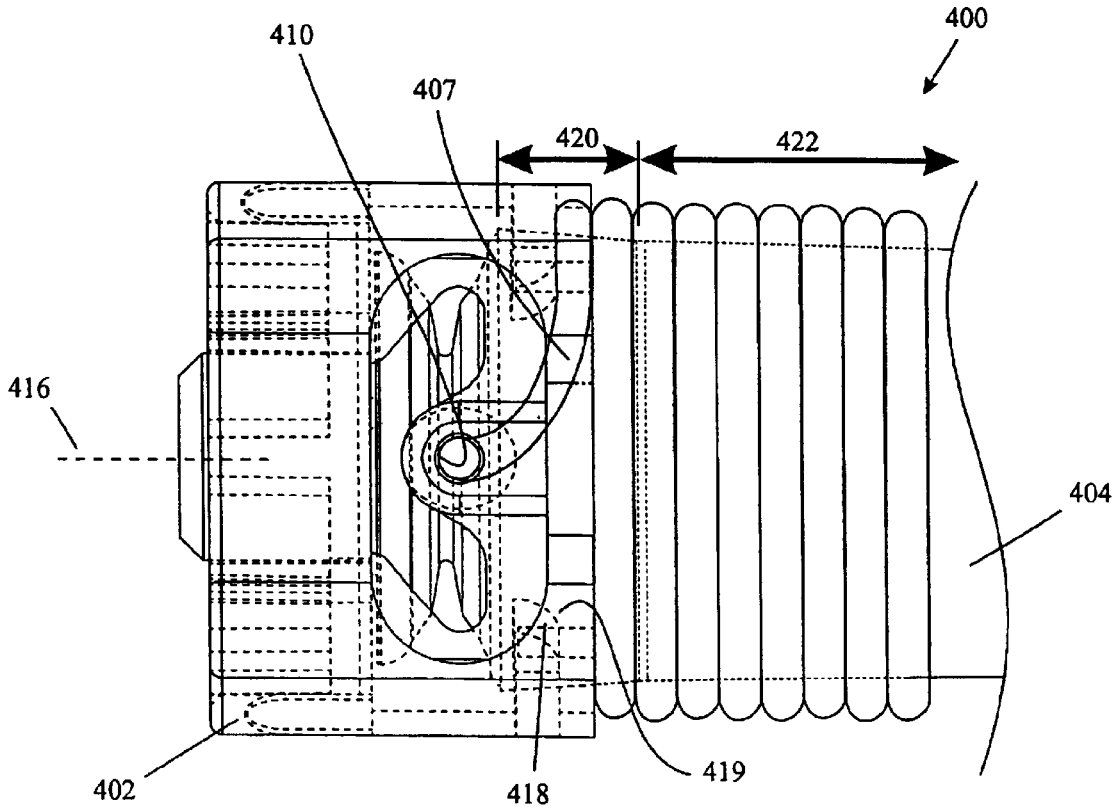
Fig. 7 Prior Art
FIG. 7 is a broken away, bottom view, similar to that of FIG. 3, but for the prior art cord drum shown in FIG. 6.

In fact, the aforementioned embodiments 300, 300' do not work as described, and the cord tends to overwrap. Due to the problems with the cord overwrapping, the drums that are currently made by Somfy differ from what is taught in the Somfy patent. The current drum 400 actually used by Somfy is shown in FIGS. 6 and 7. This drum 400 is similar to the drum 200 of FIGS. 1–3, and includes a cradle 402, a drum 404 mounted for rotation on the cradle 402 about the axis 416, and a securing cap 406. The drum 404 includes a first slightly tapered surface portion 420 (having a taper of about 4.5 degrees from the axis of rotation 416), a second slightly tapered surface portion 422 having less taper than the first drum portion 420, and a cord 407.

A shoulder 418 and a feed guide 410, are part of the cradle 402. The feed guide 410 has a diameter that is just slightly larger than the diameter of the cord 407, so it precisely feeds the cord 407 onto the surface 420 at the point 419 upstream of the shoulder 418, so, as the drum 404 rotates, the cord 407 contacts the shoulder 418. The shoulder 418 pushes against every new wrap of cord 407 which is laid on the first drum portion 420 and pushes it more than one cord diameter down the drum 404, displacing the previous wrap of cord 407, and pushing it down the tapered first drum portion 420 toward the second drum portion 422 in the direction of the arrow 427. This creates a large thrust load as in the embodiment of FIGS. 1–3, with the shoulder 418 functioning as a kicker, pushing the latest wrap of cord 407 and all the previous wraps of cord in the direction of the arrow 427, in order to clear an area for the next wrap of cord to be laid down. The force of the cord 407 against the shoulder 418 is shown by the arrow 426 in FIG. 6.

In this prior art cord drum 400, the shoulder 418 is in contact with the cord 407, and, with the aid of the feed guide 410, this shoulder 418 accurately positions the cord 407 onto the first drum portion 420. The shoulder 418 also acts as a thrust bearing surface to push or displace the existing wraps of cord 407 down the tapered surface of the first drum portion 420 to make available a clear area for the next wrap to form without overwrapping.

Figure 8:
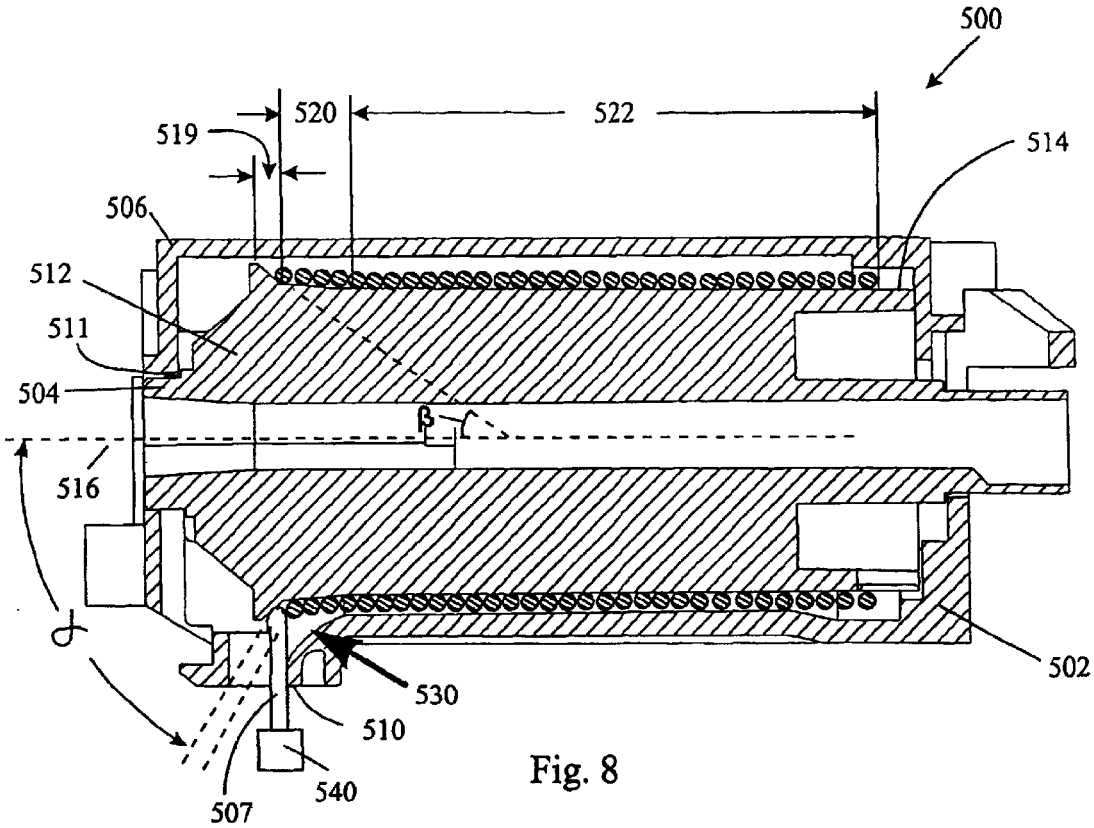
FIG. 8 is a sectional view, similar to that of FIG. 2, but showing an embodiment of a cord drum made in accordance with the present invention.
Figure 9:
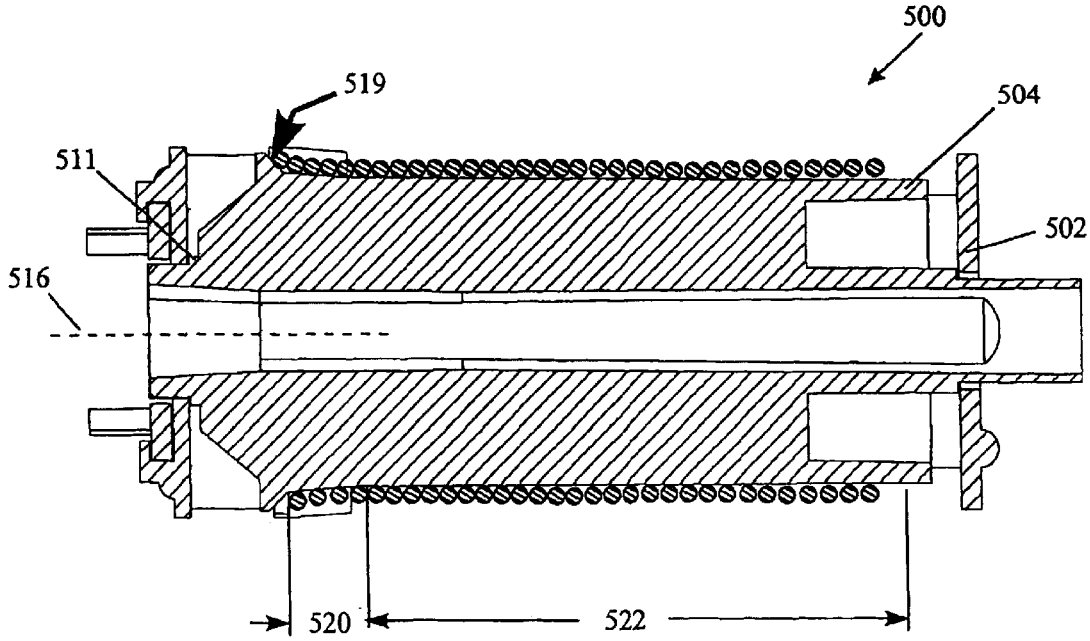
FIG. 9 is a sectional view, similar to that of FIG. 3, but for the cord drum shown in FIG. 8.
Figure 12:
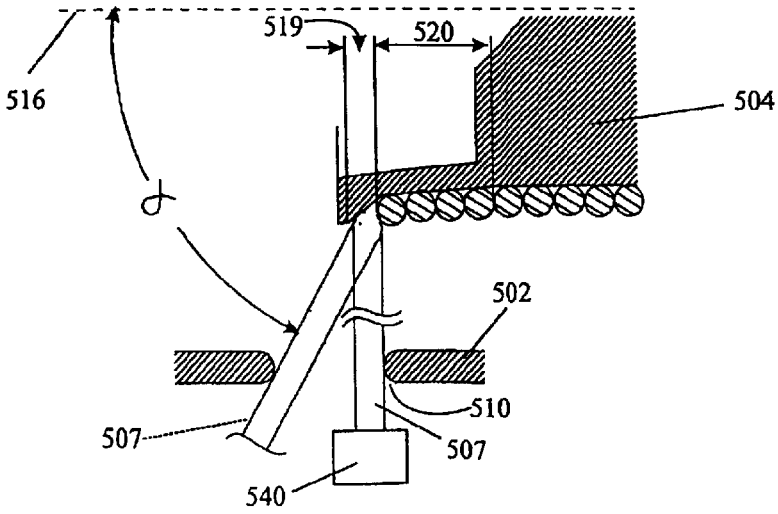
FIG. 12 is an enlarged, sectional view of the cord drum of FIG. 8.
Figure 13:
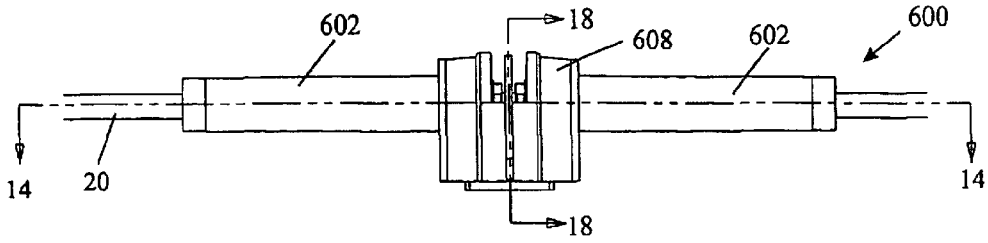
FIG. 13 is a front view of a counter wrapped cord drive made in accordance with the present invention.

FIGS. 8, 9, and 12 depict a cord drum 500 made in accordance with the present invention. This cord drum 500 includes a cradle 502, a drum 504 mounted for rotation on the cradle 502 about the axis 516, and a securing cap 506. The drum 504 has a first or upstream end 512 and a second or downstream end 514. The drum 504 includes a steeply inclined drum portion 519, a first slightly inclined drum surface portion 520, a second slightly inclined surface drum portion 522 of slightly less incline than the first drum portion 520, and a cord 507. A weight 540 at the end of the cord 507 schematically represents a load pulling on the cord. The load may be the slats of a window blind, or the hand of a person pulling on the cord, or anything else that keeps the cord taut as it is winding onto the drum 504 and unwinding from the drum 504.

As shown in FIG. 8, a feed guide 510, which is part of the cradle 502, has its right (downstream) side precisely located in order to feed the cord 507 onto the steeply inclined portion 519 an axial distance that is preferably at least ¾ of the diameter of the cord 507 up the steeply inclined portion 519, meaning that it positions the incoming cord 507 onto the steeply inclined portion 519, above the existing wrap, which has already moved onto the first tapered surface portion 520, thereby preventing overwrapping. Every new wrap of the cord 507 is laid down on the steeply inclined portion 519. The steeply inclined portion 519 is sufficiently steep so that, as the drum rotates, a load 540 that is sufficient to keep the cord taut is also sufficient to cause each newly-laid wrap to slide downstream toward the first slightly inclined surface portion 520, pushing the preceding wraps of cord down the first slightly inclined drum portion 520, creating a free space on the steeply tapered surface 519 for the next incoming wrap of the cord 507, without the need for any external pushing force.

Unlike the feed guide 210 of FIG. 2, the feed guide 510 of FIG. 8 has a large radius 530 on its downstream side, which comes into play when the cord 507 is unwinding from the drum 504. Preferably, the feed guide 510 has a radius of at least two and more preferably three cord diameters in order to reduce the friction as the cord is being unwound from the drum 504. While the cord 507 always wraps onto the drum 504 at the steeply inclined portion 519, it does not unwrap from that portion. Instead, it unwraps from wherever it ended up on the drum 504 when it was wound up onto the drum. As a result, there can be a substantial angle between the cord 507 and the feed guide 210 as the cord 507 is unwinding from positions approaching the downstream end 514 of the drum 504. The large radius 530 helps eliminate sharp bends which otherwise would tend to cause the cord 507 to fray and would tend to cause large frictional forces.

While the downstream side of the feed guide 510 is precisely located to ensure that each new wrap of cord goes onto the sharply inclined surface 519, the upstream side of the feed guide 510 in this embodiment is spaced a large distance (several cord diameters) away from the downstream side. This differs substantially from the prior art, such as the cord guide 210 of FIG. 2, where the upstream side of the cord guide 210 is just slightly greater than one cord diameter from the downstream side, leaving just enough room for the cord to slide through the cord guide 210.

The upstream side of the feed guide 510 does not have to be as close to the downstream side as was required in the prior art, because precise placement of the cord 507 on the steeply inclined portion 519 is not critical as long as it is laid at least ¾ of a cord diameter up slope from the last wrap to ensure that no over wrap condition occurs. Also, as shown in phantom in FIGS. 8 and 12, the direction of feed of the cord 507 as it contacts the drum 504 need not be perpendicular to the axis of rotation 516 of the drum 504. The upstream angle $\alpha$ between the entering cord and the axis of rotation 516 may be an acute angle as well as a right angle. The fact that the left side of the cord guide 510 is spaced a large distance away from the right side permits this great leeway in the direction of feed. The axial length of the steep incline portion 519 is preferably at least 1½ cord diameters. The steeply inclined surface 519 lies at an upstream angle $\beta$ from the axis of rotation 516, which preferably is between 10 degrees and 45 degrees.

In this embodiment, there is not a substantial thrust load external to the drum 504 as the cord 507 winds up onto the drum 504, because there is no kicker or pusher external to the drum 504 pushing the cord 507 downstream. The force needed to move the cord 507 axially is applied by the drum 504 itself (at the steep incline portion 519). The cord 507 itself pushes on the drum 504 creating a very small thrust load, with the shoulder 511 of the drum 504 pushing to the left against the housing to counter this small thrust load. Furthermore, the coefficient of friction between the spool 504 and the lift rod, which provides the bearing surface for rotation of the spool 504 along the axis of rotation 516, multiplied by the perpendicular force applied on the spool 504 by the weight 540 on the cord 507 results in a resistance to axial movement, further reducing the resultant thrust load on the shoulder 511. Since the load is very small and is applied at the small radius of the shoulder 511, there is very little torque involved as compared with prior art designs.

This cord drum 500 differs from the prior art drums in the following ways:

1. Each new wrap is laid down on a steeply inclined portion of the drum (not on a cylindrical or slightly inclined tapered portion of the drum), which is sufficiently steep that the cord 507 slides downstream without any outside pushing required. This new wrap then slides down the steep slope to push previous wraps along a lesser taper. In the prior art, the new wrap was laid down on a slightly inclined portion of the drum, and overwrap occurred unless there was a kicker or pusher to push the cord downstream.

2. There are no shoulders or kickers to force the displacement of the previous wrap of cord.

3. The feed guide has a large radius on its downstream end, and the feed guide may have a diameter substantially greater than the diameter of the cord. The feed guide does not need to accurately position the cord onto the drum, as long as it positions the cord somewhere along the steeply inclined portion, nor does the feed guide need to feed the cord substantially perpendicularly to the axis of rotation of the drum. In the prior art, the feed guide has a diameter just slightly larger than the cord diameter, and it must feed the cord onto the drum substantially perpendicularly to the axis of rotation of the drum.

4. There are no substantial external thrust loads as the cord winds up onto the drum, since the thrust load is strictly between the drum and the cord, not against outside shoulders or kickers.

ALTERNATE EMBODIMENT FOR A COUNTER-WRAPPED CORD DRIVE

FIGS. 13–16 and 18 show a counter wrapped cord drive 600 made in accordance with the present invention. This drive 600 is very similar to the counter wrapped cord drive 54 disclosed in FIGS. 8–14 of the parent application to this CIP, U.S. application Ser. No. 09/907,429. FIG. 17 is a bottom view of the housing 608' of a counter wrapped cord drive of the parent application, showing the "kickers" 604', which displace the latest wrap of the drive cord along the slightly tapered portion of the drum. The embodiment of FIGS. 13–16 and 18 has the same bottom view except it does not use these "kickers" 604'.

The counter wrapped cord drive 600 includes left and right drums or spools 602, left and right drive cords 606 (See FIGS. 14 and 15), a lift rod 20, and a cover 608. The two spools 602 are identical but are arranged in mirror image positions relative to each other, and, as may be seen in other embodiments described in the parent application, they may be made as a single piece or may have different configurations than that depicted in FIGS. 13 and 14. The spools 602 are hollow cylinders with an inside surface 610 which has a non-circular profile that closely matches the external profile of the lift rod 20, and they have an axis of rotation 617.

Figure 16:
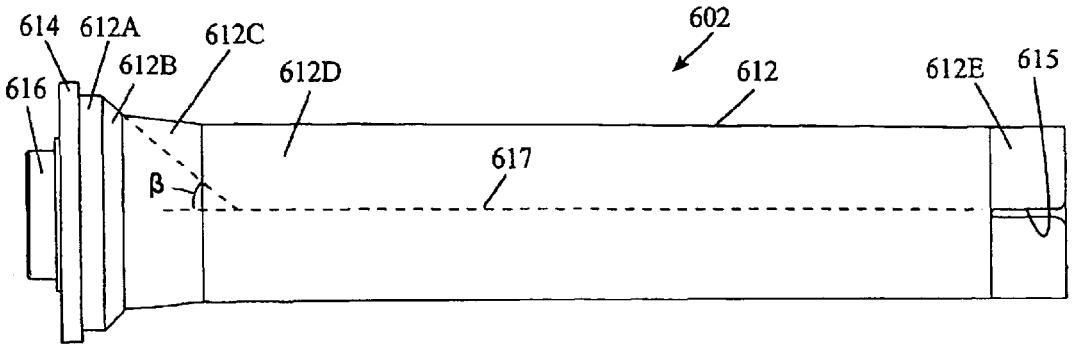
FIG. 16 is a front view of the drum on the right side of FIGS. 13 and 14.
Figure 17:
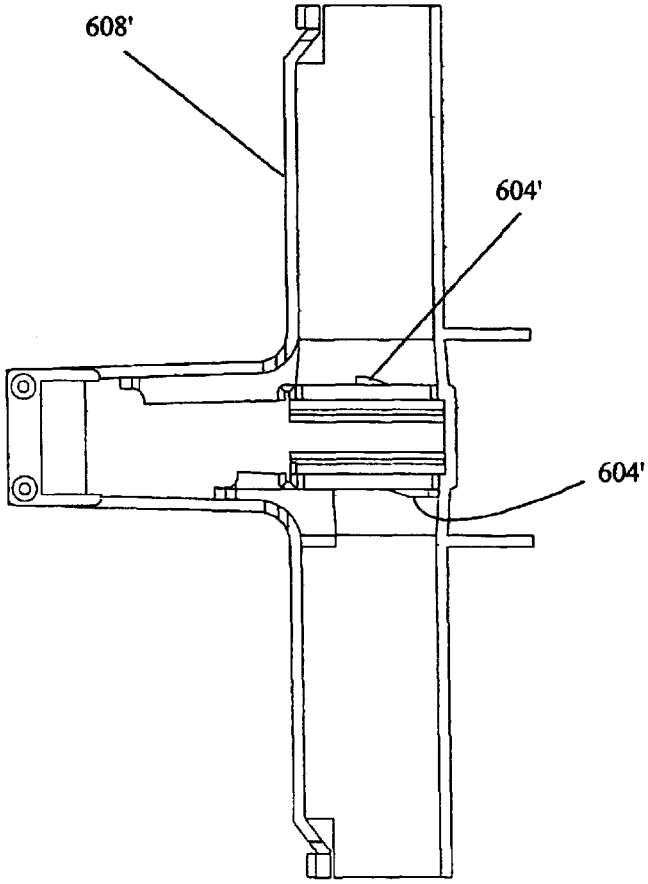
FIG. 17 is a bottom view of a housing for a counter wrapped cord drive as taught in the parent of this application.
Figure 18:
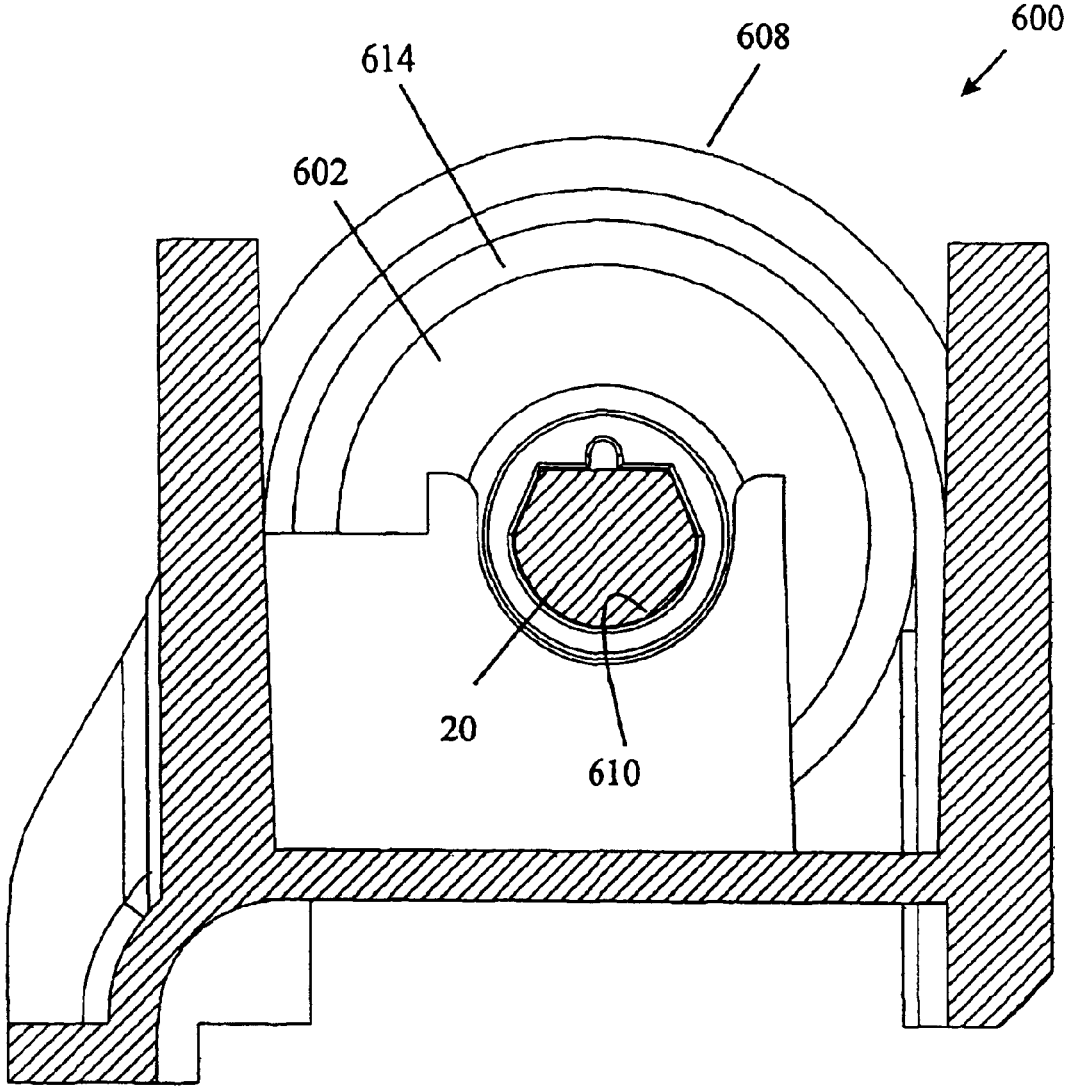
FIG. 18 is a view taken along the line 18—18 of FIG. 13.

Referring to FIG. 16, the spools 602 have an outside surface 612, which varies from its maximum diameter at the upstream end of the spool to its minimum diameter at the downstream end of the spool. The upstream end terminates in a flange 614, and the downstream end has a short slit 615, which is used to secure one end of the respective drive cord 606 to its respective spool 602. In order to fasten the drive cord 606 to the spool 602, an enlargement, such as a knot (not shown), is tied to an end of the drive cord 606. This knot is slid behind the slit 615 at the end of the spool 602, and thus the drive cord 606 is quickly and easily secured to the end of the spool 602. Beyond the flange 614 of the spool 602 is a short stub shaft 616, having a smaller outside diameter than the flange 614.

Looking more closely at the surface 612 of the spool 602 (See FIG. 16), this surface 612 has five distinct segments 612A, 612B, 612C, 612D and 612E. Segment 612A is closest to the flange 614. It is a short segment and may be either cylindrical or it may have just enough taper as is required for mold release in the fabrication process. The second segment 612B is also short and has the steepest taper of the five segments. The taper on this segment 612B must neither be too steep nor too shallow. If the taper is too steep, the cord 606 may tend to wrap onto itself, causing an undesirable over wrap condition. If the taper is too shallow, the latest wrap of cord 606 will not be displaced down the slope, also causing an over wrap condition. As described with respect to the cord drive 500 (See FIG. 8), the steeply tapered surface 612B lies at an upstream angle $\beta$ from the axis of rotation, and this upstream angle $\beta$ preferably is between 10 degrees and 45 degrees. The actual angle depends upon the materials used, their coefficients of friction, and so forth.

Figure 15:
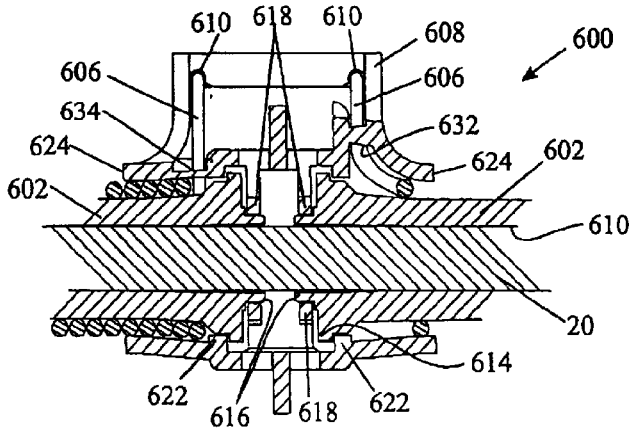
FIG. 15 is an enlarged, broken-away view of the central portion of FIG. 14.

As shown in FIG. 15, a feed guide 610, which is part of the cradle 608, is precisely located in order to feed the cord 606 onto the steeply inclined portion 612B an axial distance that is preferably at least ¾ of the diameter of the cord 606 up the steeply inclined portion 612B, meaning that it positions the incoming cord 606 onto the steeply inclined portion 612B, above the existing wrap, which has already moved onto the next slightly tapered surface portion 612C, thereby preventing overwrapping. Every new wrap of the cord 606 is laid down on the steeply inclined portion 612B. The steeply inclined portion 612B is sufficiently steep so that, as the drum rotates, a load 540 (See FIG. 8) that is sufficient to keep the cord taut is also sufficient to cause each newly-laid wrap to slide downstream toward the next slightly tapered surface portion 612C, pushing the preceding wraps of cord down this next slightly tapered surface 612C, creating a free space on the steeply tapered surface 612B for the next incoming wrap of the cord 606, without the need for any external pushing force.

The fourth segment 612D is the longest segment and is used primarily for storage of the cord 606. The amount of taper present in this segment is only that required for easy molding of the component, and this segment could be cylindrical (no taper at all) because, at this point, there is virtually no compression between the cord wraps and the cylinder surface, which allows the cord draft to be easily displaced toward the downstream end. The final segment 612E begins with the base of the slot 615, and the amount of taper present in this segment 612E is unimportant, because it is downstream from the cord wrapping surface.

The cover or cradle 608 serves several functions. First, it serves as a support for the spools 602 (together with the lift rod 20). It also serves as a mounting mechanism to mount the cord drive 600 onto the head rail (not shown). It also serves as a mechanism to guide the drive cords 606 onto the spools 602, as well as off the spools 602 and through the head rail.

Referring to FIG. 15, the cover 608 includes two portions, which are mirror images of each other. Each portion of the cover 608 is designed to fit over the respective flange 614 of one of the spools 602 in such a manner so as to lock the flange 614 in position against axial displacement while allowing free rotation of the spool 602. A projecting surface 618 on the cover 608 provides an axial stop acting against the flange 614 in one direction, while, at the same time, a semi-circular profile on this projecting surface 618 provides a bearing surface to support the stub shaft 616 on the spool 602. A shoulder 622 on the inside surface of the cover 608 acts as a second axial stop on the other side of the flange 614, effectively trapping the flange 614 between this shoulder 622 and the projecting surface 618 of the cover 608, thus fixing the axial location of the spool 602 relative to the cover 608. The cover 608 also has a short hood 624.

Figure 14:
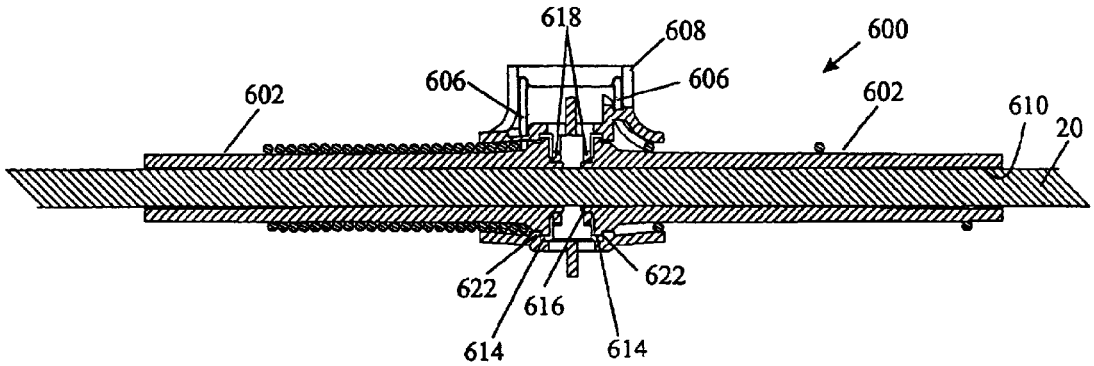
FIG. 14 is a sectional view along line 14—14 of FIG. 13.

The cover 608 also has two additional holes 632, 634 (See FIG. 15). One hole 632 is at a height which is above the axial centerline of the cord drive 600 and is used to guide one drive cord 606 as it comes into the cord drive 600, to place the drive cord 606 on the steeply tapered surface 612B of the spool 602 such that, when the spool 602 is turned counterclockwise (as seen from the vantage point of the right side of FIGS. 13 through 15), the drive cord 606 winds onto its respective spool 602. The second hole 634 is at a height which is below the axial centerline of the cord drive 600 and is used to guide the other drive cord 606 as it comes into the cord drive 600 to place it on the steeply tapered surface 612 of its respective spool 602 such that, when the spool 602 is turned counterclockwise (as seen from the vantage point of the right side of FIGS. 13 through 15), the second drive cord 606 unwinds from its spool 602. Thus the two drive cords 606 are counter-wrapped onto their respective spools 602, and since both spools 602 are connected by the lift rod 20 so as to rotate as a single unit, as the first drive cord 606 is pulled, it unwinds from its spool 602, while the second drive cord 606 winds onto the second spool 602. As each successive wrap of drive cord 606 wraps onto its respective spool 602, it displaces the previous wrap of drive cord, shoving it sideways, axially along the surface 612 of the spool 602. As can be seen in FIG. 14, the cord 606 on the right spool 602 is unwrapping, as the cord 606 on the left spool 602 is wrapping up onto its spool.

To assemble the cord drive 600, an end of a drive cord 606 is secured to its respective spool, via a knot or other enlargement, which is slid behind the slit 615. The drive cord 606 is threaded through a hole 632 or 634 in its respective cover 608 (going from the inside of the cover 608 to the outside of the cover 608), and it is further threaded through a hole in the foot (not shown) of the cover 608. The spool 602 is then installed by pushing it up from under the cover 608 such that the stub shaft 616 pushes against the upwardly projecting surface 618, which has just enough flexibility in it to bend axially to allow the stub shaft 616 to slide past the surface 618, and thus allows the spool 602 to snap into place such that its flange 614 is trapped between the shoulder 622 and the projecting surface 618 of the cover 608, and the stub shaft 616 on the spool 602 is supported by the semi-circular profile on the projecting surface 618. The spool 602 is then manually rotated in the appropriate direction until most of the drive cord 606 is wrapped onto its spool 602. This same procedure is followed for a second spool 602 and a second drive cord 606 except that, once the second spool 602 is snapped into place, its corresponding drive cord 606 is not wrapped onto its respective spool 602.

The assembled cord drive 600 is then mounted onto the head rail by inserting the foot in an opening (not shown) in the head rail for that purpose. The cord drive 600 is then pushed down until it snaps into the profile of the head rail. Finally, the lift rod 20 is inserted through the hollow inside surface 610 of both spools 602, and is extended through to connect to a lift module which is already connected to the lift cords connected to the bottom rail of the stack of slats in a manner which is well known in the art.

Now, as the end of the wrapped drive cord 606 is pulled, it unwraps from its spool 602, rotating the spool 602 as well as the lift rod 20. The second spool 602 also rotates with the lift rod 20, and in the same direction, wrapping the second drive cord 606 onto the second spool 602 as the first drive cord 606 is unwrapping from the first spool 602. Since the lift rod 20 is also connected to the lift module, the lift module will also rotate and thus raise or lower the stack of slats.

As the first drive cord 606 is pulled to unwrap from the first spool 602, the second drive cord 606 is wrapping onto the second spool 602. As this second drive cord 606 in turn is pulled to unwrap form the second spool 602, the first drive cord 606 is wrapping onto the first spool 602. Thus, one drive cord 606 is always wrapping onto a spool 602 as the other drive cord 606 is being pulled and unwrapped. The cover 608 places the cord 606 onto the steeply tapered surface 612B of the spool 602 where it is displaced down, axially along the taper as a successive wrap is laid onto the steeply tapered surface 612B of the spool 602.

It will be obvious to those skilled in the art that modifications may be made to the embodiments described above without departing from the scope of the present invention.

What is claimed is:

1. A cord-wrapping device, comprising:

a cradle;

a first drum mounted on said cradle for rotation about a first axis relative to said cradle, said drum having an upstream end and a downstream end and defining a steeply inclined inlet surface portion;

a first slightly inclined surface portion adjacent said steeply inclined portion;

a second surface portion adjacent said first slightly inclined surface portion, wherein said first slightly inclined surface portion has an acute upstream angle relative to said axis of rotation, and said second surface portion has a smaller acute upstream angle of taper relative to said axis of rotation than does said first slightly inclined portion;

a first cord mounted on said first drum, said cord having a diameter; and a feed guide fixed relative to said cradle, said feed guide directing said cord onto said steeply inclined portion as the cord wraps onto the drum, wherein the slope of said steeply inclined portion is sufficient that a load sufficient to keep the cord taut as it winds up onto the drum is also sufficient to cause the cord to slide down said steeply inclined portion toward said first slightly tapered portion and to push preceding wraps of said cord along said first slightly tapered portion as the drum rotates.

2. A cord-wrapping device as recited in claim 1, wherein said steeply inclined portion extends an axial distance that is at least 1½ cord diameters long.

3. A cord-wrapping device as recited in claim 2, wherein said steeply inclined portion forms an upstream angle relative to said axis of rotation of between 10 degrees and 45 degrees.

4. A cord-wrapping device as recited in claim 1, a wherein said feed guide directs said cord at least ¾ of a cord diameter in the upstream axial direction up said steeply inclined portion.

5. A cord-wrapping device as recited in claim 1, wherein said feed guide has an upstream guide surface and a downstream guide surface, and said upstream guide surface is located at least two cord diameters from said downstream guide surface, permitting a wide range of entry angles of said cord.

6. A cord-wrapping device comprising:

a cradle;

a first drum mounted on said cradle for rotation about a first axis relative to said cradle, said drum having an upstream end and a downstream end and defining a steeply inclined inlet surface portion and a first slightly inclined surface portion adjacent said steeply inclined portion;

a first cord mounted on said first drum, said cord having a diameter;

a feed guide fixed relative to said cradle, said feed guide directing said cord onto said steeply inclined portion as the cord wraps onto the drum, wherein the slope of said steeply inclined portion is sufficient that a load sufficient to keep the cord taut as it winds up onto the drum is also sufficient to cause the cord to slide down said steeply inclined portion toward said first slightly tapered portion and to push preceding wraps of said cord along said first slightly tapered portion as the drum rotates;

and further comprising a second drum mounted for rotation relative to a cradle about said first axis, said second drum also defining a steeply inclined inlet portion and a first slightly inclined portion adjacent said steeply inclined portion;

means for causing said first and second drums to rotate together; and a second cord mounted on said second drum, wherein said first cord unwraps from said first drum as said second cord wraps onto said second drum.

7. A cord-wrapping device as recited in claim 6, and further comprising a second feed guide which directs said second cord onto the steeply inclined portion of said second drum such that said second cord initially wraps onto its respective steeply inclined portion.

8. A cord-wrapping device as recited in claim 1, wherein said feed guide has an upstream guide surface and a downstream guide surface, said downstream guide surface defining a large radius of curvature which is at least twice the diameter of said cord.

9. A cord-wrapping device as recited in claim 5, wherein said downstream guide surface defines a large radius of curvature, which is at least twice the diameter of said cord.

10. A cord-wrapping device, comprising:

a cradle;

a first drum mounted on said cradle for rotation about a first axis relative to said cradle, said drum having an upstream end and a downstream end and defining a steeply inclined inlet surface portion forming an upstream angle relative to said axis of rotation of between 10 degrees and 45 degrees, and a first slightly inclined surface portion adjacent said steeply inclined portion;

a second surface portion adjacent said first slightly inclined surface portion, wherein said first slightly inclined surface portion has an acute upstream angle relative to said axis of rotation, and said second surface portion has a smaller acute upstream angle of taper relative to said axis of rotation than does said first slightly inclined surface portion;

a first cord mounted on said first drum, said cord having a diameter, wherein said steeply inclined inlet surface portion extends an axial distance of at least 1½ cord diameters; and a feed guide fixed relative to said cradle, said feed guide having an upstream guide surface and a downstream guide surface, said upstream and downstream guide surfaces being located at least two cord diameters apart from each other in the axial direction, wherein said downstream guide surface has a radius of curvature of at least twice the diameter of the cord, said feed guide directing said cord at least ¾ of a cord diameter in the axial direction up said steeply inclined portion as the cord wraps onto the drum, wherein the slope of said steeply inclined portion is sufficient that a load sufficient to keep the cord taut as it winds up onto the drum is also sufficient to cause the cord to slide down said steeply inclined portion toward said first slightly tapered portion and to push preceding wraps of said cord along said first slightly tapered portion as the drum rotates.

11. A cord-wrapping device, comprising:

first and second drums mounted for rotation together about a first axis;

first and second cords mounted on said first and second drums, respectively, each of said cords having a diameter, wherein said first cord unwraps from said first drum as said second cord wraps onto said second drum;

each of said drums having an upstream end and a downstream end and defining a steeply inclined inlet surface portion forming an upstream angle relative to said axis of rotation of between 10 degrees and 45 degrees, and a first slightly inclined surface portion adjacent said steeply inclined portion;

wherein said steeply inclined inlet surface portion extends an axial distance of at least ½ cord diameters; and first and second feed guides, each having an upstream guide surface and a downstream guide surface, said downstream guide surface having a radius of curvature of at least twice the diameter of the respective cord, each of said feed guides directing its respective cord at least ¾ of a cord diameter in the axial direction up its respective steeply inclined portion as the cord wraps onto its respective drum, wherein the slope of each of said steeply inclined portions is sufficient that a load sufficient to keep the respective cord taut as it winds up onto its drum is also sufficient to cause the cord to slide down its respective steeply inclined portion toward its respective first slightly tapered portion and to push preceding wraps of said cord along said first slightly tapered portion as the respective drum rotates.

12. A cord-wrapping device as recited in claim 10, wherein said second surface portion is cylindrical.

13. A cord-wrapping device as recited in claim 1, wherein said second surface portion is cylindrical.

* * * * *

UNITED STATES PATENT AND TRADEMARK OFFICE

CERTIFICATE OF CORRECTION

PATENT NO. : 6,915,831 B2
DATED : July 12, 2005
INVENTOR(S) : Richard N. Anderson It is certified that error appears in the above-identified patent and that said Letters Patent is hereby corrected as shown below:

Column 12,
Line 28, delete "1/2" and insert therefor -- 1 1/2 --.

Signed and Sealed this

Twenty-seventh Day of September, 2005

JON W. DUDAS
*Director of the United States Patent and Trademark Office*